US006143710A

United States Patent [19]

Lu et al.

[11] Patent Number: 6,143,710

[45] Date of Patent: Nov. 7, 2000

[54] AQUEOUS CLEANING AND DISINFECTING COMPOSITIONS HAVING REDUCED IRRITATION CHARACTERISTICS BASED ON QUATERNARY AMMONIUM COMPOUNDS INCLUDING BLOCK COPOLYMER SURFACTANTS AND FURTHER SURFACTANTS

[75] Inventors: Robert Zhong Lu, Hasbrouck Heights; Dennis Thomas Smialowicz, Waldwick; Ralph Edward Rypkema, Lodi; Karen Ann McCue, Tenafly; Andrew Arno Kloeppel, Mahwah, all of N.J.; Diane Joyce Burt, New Windsor, N.Y.; Michael David Love, Parsippany, N.J.; Robert William Bogart, River Vale, N.J.; Narendra Vrajlal Nanavati, Maywood, N.J.; Frederic Albert Taraschi, Skillman, N.J.

[73] Assignee: Reckitt Benckiser Inc., Wayne, N.J.

[21] Appl. No.: 09/263,418

[22] Filed: Mar. 5, 1999

[30] Foreign Application Priority Data

Apr. 14, 1998 [GB] United Kingdom ..... 9807649

[51] Int. Cl.[7] ..... C11D 17/00

[52] U.S. Cl. ..... 510/384; 510/421; 510/423; 510/475; 510/490; 510/504; 510/506

[58] Field of Search ..... 510/191, 193, 510/384, 423, 506, 475, 564, 490

[56] References Cited

U.S. PATENT DOCUMENTS

| | | | |
|---|---|---|---|
| 3,539,520 | 11/1970 | Cantor et al. | 252/106 |
| 3,954,644 | 5/1976 | Krezanoski et al. | 252/106 |
| 4,336,151 | 6/1982 | Like et al. | 252/106 |
| 5,167,872 | 12/1992 | Pancheri et al. | 252/544 |
| 5,454,520 | 10/1995 | Graubart et al. | 252/547 |
| 5,454,984 | 10/1995 | Graubart et al. | 252/547 |
| 5,523,013 | 6/1996 | Durbut et al. | 252/121 |
| 5,534,165 | 7/1996 | Pilosof et al. | 252/8.91 |

FOREIGN PATENT DOCUMENTS

| | | | |
|---|---|---|---|
| 9503633 | 2/1996 | Brazil . | |
| 0 342 997 A2 | 11/1989 | European Pat. Off. . | |
| 0 692 397 A2 | 1/1996 | European Pat. Off. . | |
| 1 226 985 | 3/1971 | United Kingdom | C11D 3/48 |
| 1 556 646 | 11/1979 | United Kingdom | C11D 1/835 |
| 2 085 020 | 4/1982 | United Kingdom | C08G 65/28 |
| WO98/45392 | 10/1998 | WIPO | C11D 1/835 |

OTHER PUBLICATIONS

Derwent Abstract XP002056330 & JP 01 132 692 A, May 25, 1989.

Derwent Abstract XP002056331 & JP 05 311 196 A, Nov. 22, 1993.

Patent Abstracts of Japan, vol. 14, No. 458, Oct. 30, 1990 & JP 02 184609 A, Jul. 19, 1990.

Copy of PCT International Search Report for PCT/US97/18873 dated Feb. 19, 1998.

Copy of GB Search Report for GB 9807649.0 dated Jul. 16, 1998.

Copy of GB Search Report for GB 9905895.0 dated May 28, 1999.

Copy of three GB Search Reports for GB 9905895.0, all dated Feb. 9, 2000.

*Primary Examiner*—Necholus Ogden

*Attorney, Agent, or Firm*—Fish & Richardson P.C.

[57] ABSTRACT

Aqueous disinfecting and cleaning compositions and concentrates which are efficacious against gram positive and gram negative bacteria, have relatively low volatile organic content ("VOC") and are surprisingly mild to the user of the compositions. The compositions include a quaternary ammonium compound as its primary germicidal active agent, have a low content of active constituents, and do not include organic solvents such as alcohols, glycols, or glycol ethers in significant amounts.

8 Claims, No Drawings

AQUEOUS CLEANING AND DISINFECTING COMPOSITIONS HAVING REDUCED IRRITATION CHARACTERISTICS BASED ON QUATERNARY AMMONIUM COMPOUNDS INCLUDING BLOCK COPOLYMER SURFACTANTS AND FURTHER SURFACTANTS

The present invention relates to improvements in cleaning compositions. More particularly the present invention is directed to improved cleaning compositions which find particular use in hard surface cleaning and disinfecting applications.

Certain hard surface formulations are known. For example, in U.S. Pat. No. 3,539,520 to Cantor et al. are illustrated certain 'detergent-sanitizer' compositions. There are essentially based on aqueous mixtures of quaternary ammonium compounds as germicidal active agents in conjunction with nonionic surfactants based on alkoxy block copolymers, and in particular, compounds based on ethoxy/propoxy block copolymers. Therein Cantor notes that such nonionic surfactants surprisingly do not interfere with the germicidal effect of the quaternary ammonium compounds, and copious examples illustrate the utility of these specific nonionic surfactants as opposed to other classes of nonionic surfactants. Cantor notes, but however does not illustrate, any significant cleaning testing or results in his compositions, and in fact teaches away from the use of these particular nonionic surfactant compounds based on ethoxy/propoxy block copolymers in conjunction with other classes of nonionic surfactants. Cantor is also wholly silent as to the dermal and ocular irritation characteristics of his compositions.

More recently, in U.S. Pat. No. 5,454,984 to Graubart et al. are recited all-purpose aqueous cleaning compositions which also include quaternary ammonium compounds as germicidal active agents, in conjunction with non-ionic surfactants which are desirably a ternary non-ionic surfactant system which includes three different nonionic surfactants. None of these nonionic surfactants of the ternary system are based on ethoxy/propoxy block copolymers. Further, the recited aqueous all-purpose aqueous cleaning compositions include an appreciable amount of an organic solvent constituent, believed to significantly facilitate the soil loosening and overall cleaning effects of these cleaning compositions.

Certain patents have recognized the fact that aqueous compositions containing quaternary ammonium compounds which provide a sanitizing benefit advantageously include one or more chemical compounds which function to mitigate such compositions, particularly with respect to the potential for ocular irritation. For example, in U.S. Pat. No. 4,336,151 to Like et al. therein are disclosed certain materials which are useful as irritation mitigants including certain ethoxylated cocodiethanolamides, certain polyoxyethylenes, certain hydrolyzed animal proteins, allantoin, 1,6-hexylene glycol, stearyl dimethylamine oxide, certain dextrose sugars and imidazole. U.S. Pat. No. 5,547,990 to Hall et al. discusses further irritation mitigants based on certain substituted imidazoline amphoteric surfactants as being useful in conjunction with didecyl dimethyl ammonium chloride, although this effect was not found with other types of quaternary ammonium compounds.

The contents of the US patent documents indicated above are incorporated herein by reference.

Notwithstanding advantageous known art formulations, there yet remains a real and continuing need in the art for improved cleaning and disinfecting compositions in general, and in specific such compositions which provide at least one, but feature a plurality of the following characteristics: low volatile organic content, low irritancy to the end user of the composition, phase stability in storage (both at freeze-thaw, room temperature (i.e., 20° C.) and elevated temperature (i.e., 40° C.) conditions), ease of fabrication, low cost, efficacy against gram positive bacteria, efficacy against gram negative bacteria, good cleaning characteristics, and relatively low percentages actives required in such an aqueous formulation.

The compositions of the invention are aqueous disinfecting and cleaning compositions and concentrates thereof which are effective cleaning compositions and are efficacious as disinfecting compositions against gram positive and gram negative bacteria, have relatively low volatile organic content ("VOC") and are mild to the user of the compositions. That these results are concurrently achieved with a composition which includes a quaternary ammonium compound as its primary germicidal active agent is surprising, and indicates a synergistic effect not apparent from the prior art. These compositions also provide good cleaning and disinfecting properties with low amounts of active constituents, and according to certain preferred embodiments do not include organic solvents such as low molecular weight alcohols, glycols or glycol ethers, in significant amounts, i.e., amounts in excess of about 1% wt and more.

In accordance with a first aspect of the invention there is provided an aqueous disinfecting and cleaning composition in a concentrated form which exhibits reduced irritancy which comprises (preferably consists essentially of):

- a disinfecting effective amount of a quaternary ammonium compound having germicidal properties, desirably present in an amount of from about 0.001–5% wt.;
- 0.01–10% wt. of a nonionic surfactant compound which is based on a polymeric alkylene oxide block copolymer;
- a mitigating effective amount of a compound selected from:
  - A) ethoxylated cellulose;
  - B) polyalkylene glycol having a molecular weight of at least 1000;
  - C) alkylamidopropylbetaines;
  - D) alkylpolyalkoxylates;
- 0.1–10% wt. of a further nonionic surfactant;
- 0–3% wt. of a polymeric cationic surfactant based on a polyquaternary ammonium salt;
- 0–3% wt. of a builder, desirably present in an amount of about 0.1–0.5% wt.;
- optionally, minor amounts of up to about 5% wt. of one or more conventional additives particularly coloring agents, fragrances and fragrance solubilizers, viscosity modifying agents such as thickeners, pH adjusting agents and pH buffers including organic and inorganic salts; and,
- water to form 1 00% wt. of the concentrate form of the inventive compositions.

In accordance with a second aspect of the invention there is provided an aqueous disinfecting and cleaning composition in a concentrated form which exhibits reduced irritancy which comprises (preferably consists essentially of):

- a disinfecting effective amount of a quaternary ammonium compound having germicidal properties, desirably present in an amount of from about 0.001–5% wt.;
- a mitigating effective amount of a binary surfactant system which includes both a nonionic surfactant compound which is based on a polymeric alkylene oxide block copolymer, and a further compound selected from:

A) ethoxylated cellulose;

B) polyalkylene glycol having a molecular weight of at least 1000;

C) alkylamidopropylbetaines;

D) alkylpolyalkoxylates;

0.1–10% wt. of a further nonionic surfactant;

0–3% wt. of a polymeric cationic surfactant based on a polyquaternary ammonium salt;

0–3% wt. of a builder, desirably present in an amount of about 0.1–0.5% wt.; optionally, minor amounts of up to about 5% wt. of one or more conventional additives particularly coloring agents, fragrances and fragrance solubilizers, viscosity modifying agents such as thickeners, pH adjusting agents and pH buffers including organic and inorganic salts; and, water to form 100% wt. of the concentrate form of the inventive compositions.

In accordance with a third aspect of the invention there is provided an aqueous dilution of the concentrated disinfecting and cleaning composition described above, which provides effective cleaning and sanitization.

In certain particularly preferred embodiments, the non-aqueous content of the compositions is particularly low, generally less comprising less than 10% wt., based on the total weight of the composition. Surprisingly however, the compositions provide both effective sanitization and good cleaning.

In a further aspect of the invention there is provided a process for cleaning and/or disinfecting surfaces in need of such treatment which includes contacting a surface with a concentrate composition or aqueous dilution of a concentrate composition as taught herein.

In a still further aspect of the invention the is provided an aqueous hard surface cleaning and sanitizing composition characterized in exhibiting a reduced potential for ocular irritancy which composition contains a quaternary ammonium compound having germicidal properties, said composition further comprising a irritation mitigating effective amount of a both a nonionic surfactant compound which is based on a polymeric alkylene oxide block copolymer in conjunction with a compound selected from the group which includes: ethoxylated cellulose, polyethylene glycols, alkylamidopropylbetaines, and alkylpolyalkoxylates.

According to a yet further aspect of the invention there is provided a process for mitigating potential ocular irritation caused by an aqueous hard surface cleaning and sanitizing composition which contains a quaternary ammonium compound having germicidal properties and a nonionic surfactant compound which is based on a polymeric alkylene oxide block copolymer, which process includes the step of providing a mitigating effective amount of a nonionic surfactant based on a alkylene oxide block copolymer to the composition, most desirably in conjunction with a compound selected from the group which includes: ethoxylated cellulose, polyethylene glycols, alkylamidopropylbetaines, and alkylpolyalkoxylates.

In particularly preferred embodiments the concentrated disinfecting and cleaning compositions provided herein provide good cleaning, effective sanitization of surfaces particularly hard surfaces, and low irritancy to the consumer, especially low ocular irritation.

The compositions of the invention include a disinfecting effective amount of a quaternary ammonium compound having germicidal properties. Particularly useful quaternary ammonium compounds and salts thereof include quaternary ammonium germicides which may be characterized by the general structural formula:

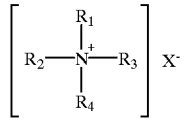

where at least one of $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of at least 165. The hydrophobic radicals may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

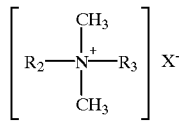

wherein $R_2$ and $R_3$ are the same or different $C_8$–$C_{12}$alkyl, or $R_2$ is $C_{1216}$alkyl, $C_{8\text{-}18}$alkylethoxy, $C_{8\text{-}18}$alkylphenolethoxy and $R_3$ is benzyl, and X is a halide, for example chloride, bromide or iodide, or X may be methosulfate. The alkyl groups recited in $R_2$ and $R_3$ may be straight chained or branched, but are preferably substantially linear.

Particularly useful quaternary germicides include compositions which include a single quaternary, as well as mixtures of two or more different quaternaries. Particularly useful quaternary germicides include BARDAC® 205M, and BARDAC® 208M or BTC® 885 which is described to be a blend of alkyl dimethyl benzyl ammonium chlorides;

BARDAC® 2050 and BARDAC® 2080 or BTC® 818 which is described to to be based on dialkyl ($C_8$–$C_{10}$) dimethyl ammonium chloride; BARDAC® 2250 and BARDAC® 2280 or BTC® 1010 which is described to a composition which includes didecyl dimethyl ammonium chloride; BARDAC® LF and BARDAC® LF 80 which is described to be based on dioctyl dimethyl ammonium chloride; BARQUAT® MB-50, HYAMINE® 3500, BARQUAT® MB-80, BTC® 835 or BTC 8358 each described to be based on alkyl dimethyl benzyl ammonium chloride; BARQUAT® MX-50, BARQUAT® MX-80, BTC® 824 or BTC® 8248 each described to be a composition based on alkyl dimethyl benzyl ammonium chloride; BARQUAT® OJ-50, BARQUAT® OJ-80, BTC® 2565, or BTC® 2658 each described to be a composition based on alkyl dimethyl benzyl ammonium chloride; BARQUAT® 4250, BARQUAT® 4280, BARQUAT® 4250Z, BARQUAT® 4280Z, BTC® 2125, or BTC® 2125M each described to be a composition based on alkyl dimethyl benzyl ammonium chloride and/or alkyl dimethyl ethyl benzyl ammonium chloride; BARQUAT® MS-100 or BTC® 324-P-100 each described to be based on myristyl dimethyl benzyl ammonium chloride; HYAMINE® 2389 described to be based on methyl dodecyl benzyl ammonium chloride and/or methyl dodecyl xylene-bis-trimethyl ammonium chloride; HYAMINE® 1622 described to be an aqueous solution of benzethonium chloride; HYAMINE® 3500-NF or BTC® 50 each described to be based on alkyl dimethyl benzyl ammonium chloride; as well as BARQUAT® 1552 or BTC® 776 described to be based on alkyl dimethyl benzyl ammonium chloride and/or dialkyl methyl benzyl ammonium chloride. (Each of these recited materials are presently commercially available from Lonza, Inc., Fairlawn, N.J. and/or from Stepan Co., Northfield Ill.). It is to be understood that these quaternary ammonium compounds may be used singly or in mixtures of two or more. These quaternary ammonium compounds are desirably present in the concentrate compositions in an amount of from about 0.001–5% wt., are desirably present in an amount of from 0.1–3% wt. and most desirably are present in an amount of from 0.5–3% wt. When diluted in a larger volume of water to form a cleaning and disinfecting composition, the quaternary ammonium compounds should be present in sufficient amount such that they are in a concentration of at least about 150 parts per million (p.p.m.), more desirably at least about 175 p.p.m. and most desirably about 200–250 p.p.m. The present inventors have surprisingly found that certain of their formulations exhibited effective cleaning and disinfecting with less than 200–250 p.p.m. of the quaternary ammonium compounds in cleaning compositions which is an amount below which is generally believed to be necessary for disinfecting efficacy.

A further constituent of invention is a nonionic surfactant compound which is based on a polymeric alkylene oxide block copolymer. Polymeric alkylene oxide block copolymers include nonionic surfactants in which the major portion of the molecule is made up of block polymeric $C_2$–$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO—(EO)_x(PO)_y(EO)_z—H \quad (A)$$

where

EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants appropriate for use in the new compositions can be represented by the formula (B):

$$R—(EO,PO)_a(EO,PO)_b\mathbf{913}\ H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000–5000.

Still further useful nonionic surfactants containing polymeric butoxy (BO) groups can be represented by formula (C) as follows:

$$RO—(BO)_n(EO)_x—H \quad (C)$$

wherein

R is an alkyl group containing 1 to 20 carbon atoms, n is about 5–15 and x is about 5–15.

Also useful as the nonionic alkylene oxide block copolymer surfactants, which also include polymeric butoxy groups, are those which may be represented by the following formula (D):

$$HO—(EO)_x(BO)_n(EO)_y—H \quad (D)$$

wherein n is about 5–15, preferably about 15, x is about 5–15, preferably about 15, and y is about 5–15, preferably about 15.

Still further useful nonionic alkylene oxide block copolymer surfactants include ethoxylated derivatives of propoxylated ethylene diamine, which may be represented by the following formula:

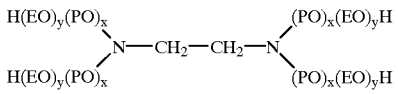

(E)

where (EO) represents ethoxy, (PO) represents propoxy, the amount of (PO), is such as to provide a molecular weight prior to ethoxylation of about 300 to 7500, and the amount of $(EO)_y$ is such as to provide about 20% to 90% of the total weight of said compound.

Of these, the most preferred are those which are represented by formula (A) above; specific examples of which include those materials presently commercially available under the tradename "Pluronic®", and in particular the Pluronic® F series, Pluronic® L series, Pluronic® P series, as well as in the Pluronic® R series, each of which are generally described to be block copolymers of propylene oxide and ethylene oxide. Generally those of the Pluronic® L series and the Pluronic® R series are preferred as these are supplied in liquid form by the manufacturer and are readily formulated into the present inventive compositions. These are also available in a wide range of HLB values, and those having HLB values in the range of 1.0–23.0 may be used, although those with intermediate HLB values such as from about 12.0–18.0 are found to be particularly advantageous. These materials are presently commercially available from BASF AG (Ludwigshafen, Germany) as well as from BASF Corp. (Mt. Olive Township, N.J.).

Other useful exemplary nonionic block copolymers based on a polymeric ethoxy/propoxy units which may also be used include those presently commercially available in the PolyTergent® E, and PolyTergent® P series of materials from Olin Chemicals Corp., (Stamford Conn.). These are described to be nonionic surfactants based on ethoxy/propoxy block copolymers, conveniently available in a liquid form from its supplier.

It is to be understood that these nonionic surfactants based on polymeric alkylene oxide block copolymers may be used singly or in mixtures of two or more such compounds. These nonionic surfactant compounds are desirably present in the concentrate compositions in an amount of from about 0.01–10% wt., desirably in an amount of 0.1–8% wt. and most desirably in an amount of 0.5–4% wt.

In accordance with the first aspect of the invention, the compositions also include a mitigating effective amount of a compound selected from: A) ethoxylated cellulose; B) polyalkylene glycols; C) alkylamidopropylbetaines and D) alkylpolyalkoxylates.

Ethoxylated celluloses which are useful as compound A) include those which are known to the art. Such useful ethoxylated celluloses are available from a variety of sources. An example of a useful and particularly preferred ethoxylated cellulose is one which is presently marketed as Cellulose® QP 52000 (Union Carbide Corp.). Further examples of particularly preferred ethoxylated celluloses are indicated in the Examples, below.

Generally, the ethoxylated cellulose compound is found to be effective when present from about 0.01–5% wt. based on the total weight of the composition, but amounts of from 0.1–2% wt., and especially amounts of from about 0.2–1% wt. are yet more satisfactory and are more preferred.

Exemplary polyalkylene glycols which are useful as compound B) include, for example, polyethylene glycols which are nonionic polymers of ethylene oxide according to the general formula:

$$HOCH_2—(CH_2CH_2O)_n—CH_2OH$$

wherein n represents the average number of oxyethylene groups. The value of n should be sufficiently large such that the compounds have a molecular weight of at least about 1000, but more desirably of from about 2000 to about 20,000. Particularly useful as compound B) are polyalkylene glycols, especially polyethylene glycols having a molecular weight of at least 1000, preferably in the range of from 1000–20,000. Such materials are commercially available in the Carbowax® (ex. Union Carbide) series and in a variety of molecular weight grades. The molecular weight range of these Carbowax® polyethylene glycols is desirably at least about 1000, up to about 20,000. More preferably compound B) has a molecular weight in the range from about 2000 to about 10,000, but most preferably from 2,000–6,000. It should be understood that other polymeric polyalkylene glycol compounds other than those exemplified above are also contemplated to be useful in the practice of the instant invention. Such other polyethylene glycol compounds desirably have a molecular weight within the parameters discussed immediately above.

Typically, the polyalkylene glycols, especially polyethylene glycols are found to be effective when present from about 0.01–10% wt. based on the total weight of the composition, but amounts of from 0.1–6% wt. and preferably from about 0.5–4% wt. are found to be satisfactory. A particularly preferred polyalkylene glycol compound is one which is commercially available as Carbowax® 4600 (Union Carbide Corp.). Further examples of particularly useful polyalkylene glycols include those which are described with reference to the Examples. It is contemplated that polyalkylene glycols, especially polypropylene glycols may also be used as part of, or in place of the polyethylene glycol constituent described immediately above.

Alkylamidopropylbetaines which are especially useful as compound C) include, for example those which may be represented by the following general formula:

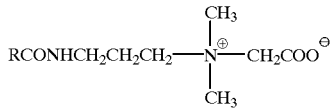

wherein

R is a hydrophobic group selected from the group selected from alkyl and alkenyl groups containing from about 10 to about 22 carbon atoms, preferably is selected from alkyl groups having from about 12 to about 18 carbon atoms.

Examples of preferred alkylamidopropylbetaines include lauramidopropyl betaine, which is available under the tradename Mirataine® (from Rhône-Poulenc, Cherry Hill, N.J.), cocamidopropyl betaine available under the tradename Mackam™ DZ (from McIntyre Group Ltd., University Park, Ill.) or under the tradename Lonzaine® C (Lonza Inc., Fairlawn, N.J.). Further examples of particularly preferred alkylamidopropylbetaines are indicated in the Examples, below.

Generally, the alkylamidopropylbetaines compound is found to be effective when present from about 0.01–10% wt. based on the total weight of the composition, but amounts of from 0.1–6% wt. and preferably from about 0.5–4% wt. are found to be satisfactory.

Exemplary useful, and preferred alkylpolyalkoxylates which are useful as compound D) Include compounds which may be represented by the following structures:

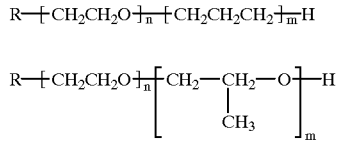

(1)

(2)

wherein in each of structures (1) and (2),

R represents a C6–C24 alkyl group, preferably a C8–C18 alkyl group, m is a value of at least 1, n is a value of at least 1, wherein the values of m+n are selected such that the molecular weights of the compounds (1) and (2) are at least 1000, preferably at are from 1000–12,000, still more desirably are from 2,000–10,000 and most preferably are from 4,000–8,000.

The polyalkoxylate compounds which find use as compound D) include known and commercially available alkyl ethoxylated/propoxylated alkanols available as nonionic surfactants. Particularly useful as compound D) are $C_8$–$C_{24}$ ethoxylated/propoxylated alcohols, particularly $C_{10}$–$C_{16}$ ethoxylated/propoxylated alcohols. An exemplary and particularly preferred material for use as compound D) are those compositions presently marketed as Tergitol® MDS-42 (Union Carbide, Danbury Conn.) and which are described to be alkylpolyalkoxylated alcohols. Further examples of particularly preferred alkylpolyalkoxylates are indicated in the Examples, below.

With respect to alkylpolyalkoxylates, these are usually found to be effective when present from about 0.01–10% wt. based on the total weight of the composition, but amounts of from 0.1–6% wt. and preferably from about 0.5–4% wt. are found to be satisfactory.

The preferred amounts of amounts of the A) ethoxylated cellulose; B) polyalkylene glycols; C) alkylamidopropylbetaines or D) alkylpolyalkoxylates which are to be included in the present inventive compositions may vary in accordance with the level of irritancy mitigation sought. For each of the compounds A) through D) it is to be understood that the amount which is to be included will vary upon several factors such as the amounts of the other constituents present in a composition, as well as the irritancy levels of such other constituents. The optimal amount of the selected compound A), B), C) or D) to be included may be determined by routine experimentation, such as by the method outlined with reference to the Examples. It is to be understood however that the weight ranges given above provide particularly satisfactory compositions.

Each of these compounds A) through D) are available from a variety of commercial sources, including those indicated above. Particularly preferred examples of compounds A) through D) and their suppliers, are described with reference to the Examples, below.

The inclusion of one of the compounds A), B), C) or D) to the compositions significantly reduce the irritation potential of the aqueous compositions as compared to like compositions which however omit this constituent. A mitigating effect has been particularly observed wherein both a nonionic surfactant constituent based on a polymeric alkylene oxide block copolymer is present, especially the preferred such compound indicated above is present. In corresponding copending U.S. Ser. No 08/984670 compositions which included only the nonionic surfactant constituent based on a polymeric alkylene oxide block copolymer were found to have generally satisfactory low ocular irritation potential. However, compositions according to particularly preferred embodiments of the present invention which further one of the compounds A) through D) have even further reduced ocular irritation potential. While not wishing to be bound by the following, it is theorized that the presence of these compounds has an effect in mitigating the irritancy of the concentrate compositions of which it forms a part. This is particularly believed to be true were both the nonionic surfactant constituent based on a polymeric alkylene oxide block copolymer in conjunction with one of these compounds A) through D) are both present. Such a combination is particularly preferred and forms the basis for the second aspect of the present invention. When two such compounds are present, these form a binary system which is suspected of having a synergistic or at least a complementary effect in reducing the irritation potential of such aqueous compositions.

When both are present as per the second aspect of the invention, the relative weights of the polymeric alkylene oxide block copolymer to the A) ethoxylated cellulose is desirably from 1:0.1 to 1:1.

When both are present as per the second aspect of the invention, the relative weights of the polymeric alkylene oxide block copolymer to the B) synthetic wax is desirably from 2:1 to 1:2.

When both are present as per the second aspect of the invention, the relative weights of the polymeric alkylene oxide block copolymer to the C) alkylamidopropylbetaines is desirably from 2:1 to 1:2.

When both are present as per the second aspect of the invention, the relative weights of the polymeric alkylene oxide block copolymer to the D) alkylpolyalkoxylates is desirably from 2:1 to 1:2.

The inventive compositions include at least one further nonionic surfactant which provide a primary detersive benefit to the inventive compositions. Preferred nonionic surfactants provide surprisingly good levels of cleaning performance, particularly in conjunction with the preferred quaternary ammonium compounds described herein.

One class of nonionic surfactants are alkoxylated alcohols. These include the condensation products of a higher alcohol (e.g., an alkanol containing about 8 to 18 carbon atoms in a straight or branched chain configuration) condensed with about 2 to 30 moles of ethylene oxide, for example, lauryl or myristyl alcohol condensed with about 16 moles of ethylene oxide, tridecanol condensed with about 6 to moles of ethylene oxide, myristyl alcohol condensed with about 10 moles of ethylene oxide per mole of myristyl alcohol, the condensation product of ethylene oxide with a distillation or separation fraction of coconut fatty alcohol containing a mixture of fatty alcohols with alkyl chains varying from 10 to about 14 carbon atoms in length and wherein the condensate contains either about 6 moles of ethylene oxide per mole of total alcohol or about 9 moles of ethylene oxide per mole of alcohol and tallow alcohol ethoxylates containing 6 ethylene oxide to 11 ethylene oxide per mole of alcohol.

A preferred group of the foregoing nonionic surfactants are the Neodol® ethoxylates (Shell Chemical Co., Houston Tex.); which are higher aliphatic, primary alcohols containing about 9–15 carbon atoms, such as a $C_{11}$ alkanol condensed with 7 moles of ethylene oxide (Neodol® 1-7), $C_9$–$C_{11}$ alkanol condensed with an average of 2.5 moles of ethylene oxide (Neodol® 91-2.5); $C_9$–$C_{11}$ alkanol condensed with 6 moles of ethylene oxide (Neodol® 91-6), $C_9$–$C_{11}$ alkanol condensed with 8 moles of ethylene oxide (Neodol® 91-8), $C_{12-13}$ alkanol condensed with 6.5 moles ethylene oxide (Neodol® 23-6.5), $C_{12-13}$ alkanol condensed with 7 moles ethylene oxide (Neodol® 23-7), $C_{12-15}$ alkanol condensed with 7 moles of ethylene oxide (Neodol® 25-7), $C_{12-15}$ alkanol condensed with 9 moles ethylene oxide (Neodol® 25-9), $C_{12-15}$ alkanol condensed with 12 moles ethylene oxide (Neodol® 25-12), $C_{14-15}$ alkanol condensed with 13 moles ethylene oxide (Neodol® 45-13), and the like.

A further class of nonionic surfactants which are advantageously present in the inventive compositions are those presently marketed under the Genapol® tradename. Particularly useful are those in the Genapol® "26-L" series which include for example: C12–16 linear alcohols condensed with 1 mole of ethylene oxide (Genapol® 24-L-3); C12–16 linear alcohols condensed with 1.6 moles of ethylene oxide (Genapol® 26-L-1.6); C12–16 linear alcohols condensed with 2 moles of ethylene oxide (Genapol® 26-L-2); C12–16 linear alcohols condensed with 3 moles of ethylene oxide (Genapol®R 26-L-3); C12–16 linear alcohols condensed with 5 moles of ethylene oxide (Genapol® 26-L-5); as well as C12–16 linear alcohols condensed with varying amounts of ethylene oxide to provide specific cloud points of the surfactant (i.e., Genapol® 26-L-60, Genapol® 26-L-60N, and Genapol® 26-L-98N). These materials are commercially available from a variety of sources, including Clariant Corp. (Charlotte, N.C.).

Additional useful nonionic surfactants include those based on alcohol and ethylene oxide condensates of a secondary aliphatic alcohol. These alcohols contain 8 to 18 carbon atoms in a straight or branched chain configuration and are condensed with 5 to 30 moles of an alkylene oxide, especially ethylene oxide. Examples of commercially available nonionic detergents of the foregoing type are $C_{11}$–$C_{15}$ secondary alkanols condensed with either 9 ethylene oxides (Tergitol® 15-S-9) or 7 ethylene oxides (Tergitol® 15-S-7) marketed by Union Carbide Corp. (Danbury Conn.). It is to be understood that these nonionic alkoxylated secondary alcohol surfactant compounds may be used singly or in mixtures of two or more such compounds.

Further useful nonionic surfactants include certain alkoxylated linear aliphatic alcohol surfactants which are believed to be the condensation products of a $C_8$–$C_{10}$ hydrophilic moiety with alkylene oxides, especially polyethylene oxide and or polypropylene oxide moieties. Such alkoxylated linear alcohol surfactants are presently commercially available under the tradename PolyTergent® (Olin Chemical Co., Stamford Conn.). Of these particularly useful are those which are marketed as PolyTergent®R SL-22, PolyTergent® SL-42, PolyTergent® SL-62 and PolyTergent® SL-29, of which PolyTergent® SL-62 is particularly advantageous. PolyTergent® SL-92 is described as being a moderately foaming, biodegradable alkoxylated linear alcohol surfactant having on average 8 moles of oxyethylene groups per molecule. These alkoxylated linear alcohol surfactants provide good detersive action in the removal of many types of fats and greases such as are frequently found in soils on hard surfaces, as well as providing a further solubilizing effects and may be included in the concentrate compositions according to the present invention with advantage. The preferred alkoxylated linear alcohol surfactants also exhibit low levels of ocular irritation in the concentrate compositions.

Further useful nonionic surfactants include alkoxylated, and particularly ethoxylated octyl and nonyl phenols according to the following general structural formulas:

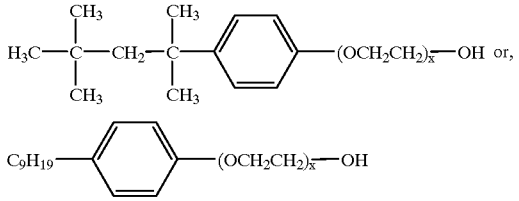

in which the $C_9H_{19}$ group in the latter formula is a mixture of branched chained isomers. In both formulae, x indicates an average number of ethoxy units in the side chain. Suitable non-ionic ethoxylated octyl and nonyl phenols include those having from about 7 to about 13 ethoxy units. Such compounds are commercially available under the trade name Triton® X (Union Carbide, Danbury Conn.).

Exemplary alkoxylated alkyl phenols useful as a nonionic surfactant also include certain compositions presently commercially available from the Rhône-Poulenc Co., (Cranbury, N.J.) under the general trade name Igepal®, which are described to be octyl and nonyl phenols. These specifically include Igepal® CO730 which is described as an ethoxylated nonyl phenol having an average of 15 ethoxy groups per molecule.

These further nonionic surfactant compounds described above may be used singly or in mixtures. They comprise 0.1–10% wt. of the concentrate compositions, desirably comprise 0.1–7% wt. and most desirably comprise about 2–6% wt. and especially about 5% wt. of the concentrate compositions taught herein.

The inventive compositions optionally but desirably include a builder. Such a builder constituent may be present in an amount of from 0–3% wt. or preferably 0.1–0.5% wt. based on the total weight of the concentrate compositions taught herein. Such include water soluble inorganic builders which can be used alone, in admixture with other water soluble inorganic builders, as well as in conjunction with one or more organic alkaline sequestrant builder salts. Exemplary builders include alkali metal carbonates, phosphates, polyphosphates and silicates. More specific examples include sodium tripolyphosphate, sodium carbonate, sodium bicarbonate, sodium tetraborate, potassium carbonate, sodium polyphosphate, potassium pyrophosphate, potassium tripolyphosphate, and sodium hexametaphosphate. Further exemplary builders also include organic alkaline sequestrant builder salts such as alkali metal polycarboxylates including water-soluble citrates such as sodium and potassium citrate, sodium and potassium tartarate, sodium and potassium ethylenediaminetetraacetate, sodium and potassium N-(2-hydroxyethyl)-ethylene diamine triacetates, sodium and potassium nitrilotriacetates, as well as sodium and potassium tartrate mono- and di-succinates. Also useful are gluconate or glucoheptonate salts particularly sodium gluconate and sodium glucoheptonate. Particularly advantageously used are di-, tri- and tetrasodium salts of ethylenediaminetetraacetic acid, especially tetrasodium salts thereof. As noted, these organic builder salts may be used individually, as a combination of two or more organic builder salts, as well as in conjunction with one or more detergency builders, including those indicated above. It is also to be appreciated that many of these constituents which are useful as builders often also provide a beneficial pH adjusting effect.

As is noted above, the compositions according to the invention are aqueous in nature. Water is added to the constituents in order to provide 100% by weight of the composition. The water may be tap water, but is preferably distilled and is most preferably deionized water. If the water is tap water, it is preferably substantially free of any undesirable impurities such as organics or inorganics, especially mineral salts which are present in hard water which may thus interfere with the operation of one or more of the constituents of the aqueous compositions according to the invention. Preferably the concentrate compositions are at least 80% wt. water.

An optional but particularly desirable further constituent is a cationic polymeric polyquaternary ammonium salt, especially a halogen salt such as a chloride salt. Such a material is one which includes at least one repeating monomer unit wherein such monomer includes as part of its structure a quaternary ammonium. A particularly useful class of such materials are those sold under the trade designation "Mirapolg" and are available from Rhônc-Poulenc Surfactant & Specialty Chemicals Co. (Cranbury, N.J.). These materials are highly cationic in nature, and are believed to be in accordance with the following general structure:

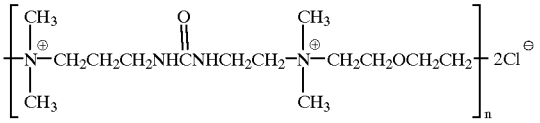

wherein n is an integer or 2 or greater, and is desirably in the range of 2–12, more desirably is about 6. Such a material is commercially available as Mirapol® A-15 from Rhône-Poulenc, identified above. When present, they may be included to 3% wt.

The inventors have found that the inclusion of such material provides a useful soil suspending benefit which is desirable from a cleaning standpoint, although it has also been observed by the inventors that inclusion of such a material may have a detrimental effect on the disinfecting properties of the compositions.

The constituents which may be used in the compositions according to the invention are known, many of which are described in *McCutcheon 's Detergents and Emulsifiers,* North American Edition, 1991; *Kirk-Othmer, Encyclopedia of Chemical Technology,* 3rd Ed., Vol. 22, pp. 346–387, the contents of which are herein incorporated by reference.

The compositions according to the invention are useful in the disinfecting and/or cleaning of surfaces, especially hard surfaces in need of such treatment. These in particular include surfaces wherein the presence of gram positive and/or gram negative bacteria are suspected. In accordance with the present inventive process, cleaning and/or disinfecting of such surfaces comprises the step of applying a stain releasing and a disinfecting effective amount of a composition as taught herein to such a stained surface. Afterwards, the compositions are optionally but desirably wiped, scrubbed or otherwise physically contacted with the hard surface, and further optionally, may be subsequently rinsed from such a cleaned and disinfected hard surface.

Such a hard surface cleaning and disinfecting composition according to the invention is may be provided as a ready to use product which may be directly applied to a hard surface, but is desirably provided in a concentrated form intended to be diluted in water to form a cleaning composition therefrom.

By way of example, hard surfaces include surfaces composed of refractory materials such as: glazed and unglazed tile, porcelain, ceramics as well as stone including marble, granite, and other stones surfaces; glass; metals; plastics e.g. polyester, vinyl; fiberglass, Formica®, Corian® and other hard surfaces known to the industry. Hard surfaces which are to be particularly denoted are lavatory fixtures such as shower stalls, bathtubs and bathing appliances (racks, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, Formica®, Corian® and stone.

The hard surface cleaner composition provided according to the invention can be also be provided as a ready to use product in a manually operated spray dispensing container. Such a typical container is generally made of synthetic polymer plastic material such as polyethylene, polypropylene, polyvinyl chloride or the like and includes spray nozzle, a dip tube and associated pump dispensing parts and is thus ideally suited for use in a consumer "spray and wipe" application. In such an application, the consumer generally applies an effective amount of the cleaning composition using the pump and within a few moments thereafter, wipes off the treated area with a rag, towel, or sponge, usually a disposable paper towel or sponge. In certain applications, however, especially where undesirable stain deposits are heavy, the cleaning composition according to the invention may be left on the stained area until it has effectively loosened the stain deposits after which it may then be wiped off, rinsed off, or otherwise removed. For particularly heavy deposits of such undesired stains, multiple applications may also be used.

In a yet a further embodiment, the compositions according to the invention may be formulated so that it may be useful in conjunction with a "aerosol" type product wherein it is discharged from a pressurized aerosol container. If the inventive compositions are used in an aerosol type product, it is preferred that corrosion resistant aerosol containers such as coated or lined aerosol containers be used. Such are preferred as they are known to be resistant to the effects of basic formulations. Known art propellants such as liquid propellants as well as propellants of the non-liquid form, i.e., pressurized gases, including carbon dioxide, air, nitrogen, hydrocarbons as well as others may be used. Also, while satisfactory for use, fluorocarbons may be used as a propellant but for environmental and regulatory reasons their use is preferably avoided. In such an embodiment, the cleaning composition is dispensed by activating the release nozzle of said aerosol type container onto the stain and/or stain area, and in accordance with a manner as above-described a stain is treated and removed.

Whereas the present invention is intended to be used in the types of liquid forms described, the compositions according to the invention are desirably diluted with a further amount of water to form a cleaning and disinfecting solution therefrom. In such a proposed diluted cleaning solution, the greater the proportion of water added to form said cleaning dilution, the greater may be the reduction of the rate and/or efficacy of the thus formed cleaning solution in the cleaning of a hard surface, as well as a reduction in disinfectant efficacy. Accordingly, longer residence times upon the stain to effect their loosening and/or the usage of greater amounts may be necessitated. Conversely, nothing in the specification shall be also understood to limit the forming of a "super-concentrated" cleaning composition based upon the composition described above. Such a super-concentrated composition is essentially the same as the compositions described above except in that they include a lesser amount of water.

While the cleaning compositions are most beneficial for use in their form, i.e., their form as described above, they may also be diluted to form a cleaning composition therefrom. Such cleaning compositions may be easily prepared by diluting measured amounts of the compositions in further amounts of water by the consumer or other end user in certain weight ratios of composition: water, and optionally, agitating the same to ensure even distribution of the composition in the water. The concentrate compositions according to the invention may be used without further dilution, but may also be used with a further aqueous dilution, i.e., in concentrate composition: water concentrations of 1:0, to extremely dilute dilutions such as 1:1000. When subjected to further aqueous dilution, such a dilution is preferably a weight or volume ratio proportion of from 1:10–1:64, and most desirably is about 1:64. The actual dilution selected is in part determinable by the degree and amount of dirt and grime to be removed from a surface(s), the amount of mechanical force imparted to remove the same, as well as the observed efficacy of a particular dilution. Generally better results and faster removal is to be expected at lower relative dilutions of the composition and the water.

Other conventional optional additives, although not particularly elucidated herein may also be included in the present inventive compositions. Exemplary optional conventional additives include but are not limited to: pH adjusting agents and pH buffers including organic and inorganic salts; non-aqueous solvents, perfumes, perfume carriers, optical brighteners, coloring agents such as dyes and pigments, opacifying agents, hydrotropes, antifoaming agents, viscosity modifying agents such as thickeners, enzymes, anti-spotting agents, anti-oxidants, anti-corrosion agents as well as others not specifically elucidated here. These should be present in minor amounts, preferably in total comprise less than about 5% by weight of the compositions, and desirably less than about 3% wt.

The following examples below illustrate exemplary and preferred formulations of the concentrate composition according to the instant invention. It is to be understood that these examples are presented by means of illustration only and that further useful formulations fall within the scope of this invention and the claims may be readily produced by one skilled in the art and not deviate from the scope and spirit of the invention.

Throughout this specification and in the accompanying claims, weight percents of any constituent are to be understood as the weight percent of the active portion of the referenced constituent, unless otherwise indicated.

EXAMPLE FORMULATIONS

Preparation of Example Formulations:

Exemplary formulations illustrating certain preferred embodiments of the inventive compositions and described in more detail in Table 1 below were formulated generally in accordance with the following protocol. These constituents were used "as is" from their respective supplier.

Into a suitably sized vessel, a measured amount of water was provided after which the constituents were added in no specific or uniform sequence, which indicated that the order of addition of the constituents was not critical. All of the constituents were supplied at room temperature, and any remaining amount of water was added thereafter. Certain of the nonionic surfactants if gels at room temperature were first preheated to render them pourable liquids prior to addition and mixing. Mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous. The exemplary compositions were readily pourable, and retained well mixed characteristics (i.e., stable mixtures) upon standing for extend periods. The compositions of the example formulations are listed on Table 1.

TABLE 1

| | Control 1 | Ex. 1 | Ex. 2 | Ex. 3 | Ex. 4 |
|---|---|---|---|---|---|
| Neodol ® 25-7 | 5.00 | 5.00 | 5.00 | 5.00 | 5.00 |
| BTC ® 8358 (80%) | 1.625 | 1.625 | 1.625 | 1.625 | 1.625 |
| Pluronic ® L-64 | 2.00 | 2.00 | 2.00 | 2.00 | 2.00 |
| Cellulose ® QP 52000 | — | 0.55 | — | — | — |

TABLE 1-continued

| | Control 1 | Ex. 1 | Ex. 2 | Ex. 3 | Ex. 4 |
|---|---|---|---|---|---|
| Carbowax ® 4600 | — | — | 2.00 | — | — |
| Lonzaine ® C (35%) | — | — | — | 3.71 | — |
| Tergitol ® MDS-42 | — | — | — | — | 2.00 |
| EDTA (38%) | 0.25 | 0.25 | 0.25 | 0.25 | 0.25 |
| Fragrance | 0.20 | 0.30 | 0.20 | 0.20 | 0.20 |
| dye solution | 0.20 | 0.40 | 0.20 | 0.20 | 0.20 |
| water | q.s. | q.s. | q.s. | q.s. | q.s. |

As is indicated, to all of the formulations of Table 1 was added sufficient deionized water in "quantum sufficient" to provide 100 parts by weight of a particular formulation.

The identity of the constituents of Table 1 above are described in more detail on Table 2, below, including the "actives" percentage of each were a constituent was not 100% wt. "actives".

TABLE 2

| constituent: | identity: |
|---|---|
| Pluronic ® L-64 | nonionic ethoxy/propoxy block copolymer surfactant (BASF Corp.) |
| Neodol ® 25-7 | nonionic C12–15 alkanol condensed with 7 moles ethylene oxide (Shell Chemical Co.) |
| BTC ® 8358 (80%) | alkyl dimethyl benzyl ammonium chloride (Stepan Co.) |
| Cellulose ® QP 52000 | ethoxylated cellulose (Union Carbide Corp.) |
| Carbowax ® 4600 | polyethylene glycol (Union Carbide Corp.) |
| Lonzaine ® C (35%) | cocoamidopropyl betaine (Lonza Corp.) |
| Tergitol ® MDS-42 | alkylpolyalkoxylated alcohol (Union Carbide Corp.) |
| EDTA (38%) | tetrasodium ethylenediaminetetraacetate |
| Fragrance | proprietary composition |
| dye solution | proprietary composition |
| DI water | deionized water |

Evaluation of Antimicrobial Efficacy:

Several of the exemplary formulations described in more detail on Table 1 above were evaluated in order to evaluate their antimicrobial efficacy against *Staphylococcus aureus* (gram positive type pathogenic bacteria) (ATCC 6538), and *Salmonella choleraesuis* (gram negative type pathogenic bacteria) (ATCC 10708). The testing was performed in accordance with the protocols outlined in "Use-Dilution Method", Protocols 955.14, 955.15 and 964.02 described in Chapter 6 of "Official Methods of Analysis", 16$^{th}$ Edition, of the Association of Official Analytical Chemists; "Germicidal and Detergent Sanitizing Action of Disinfectants", 960.09 described in Chapter 6 of "Official Methods of Analysis", 15$^{th}$ Edition, of the Association of Official Analytical Chemists; or American Society for Testing and Materials (ASTM) E 1054-91 the contents of which are herein incorporated by reference. This test is also commonly referred to as the "AOAC Use-Dilution Test Method".

As is appreciated by the skilled practitioner in the art, the results of the AOAC Use-Dilution Test Method indicates the number of test substrates wherein the tested organism remains viable after contact for 10 minutes with at test disinfecting composition /total number of tested substrates (cylinders) evaluated in accordance with the AOAC Use-Dilution Test. Thus, a result of "0/60" indicates that of 60 test substrates bearing the test organism and contacted for 10 minutes in a test disinfecting composition, 0 test substrates had viable (live) test organisms at the conclusion of the test. Such a result is excellent, illustrating the excellent disinfecting efficacy of the tested composition. Results for lesser amount of test substrates such as for 10, 20, 30 or 40 test substrates provide useful screening results, although insufficient to satisfy the requirement of 60 test substrates as dictated by the AOAC Use-Dilution Test.

Results of the antimicrobial testing are indicated on Table 3, below. The reported results indicate the number of test cylinders with live test organisms/number of test cylinders tested for each example formulation and organism tested.

TABLE 3

| Formulation: | *Staphylococcus aureus* | *Salmonella choleraesuis* |
|---|---|---|
| Comp. 1 | 0/30 | 0/30 |
| Ex.1 | 0/10 | — |
| Ex.2 | 0/10 | — |
| Ex.3 | 0/10 | — |
| Ex.4 | 0/10 | — |

"—" indicates not tested

Evaluation of Ocular Irritation:

The ocular irritation characteristics of formulations according to the invention were evaluated using the known Draize Eye test protocol. Evaluation was performed on several formulations according to the invention and described more fully in Table 1 above.

As known to those skilled in the art, the Draize Eye Test measures eye irritation for the grading of severity of ocular lesions, measuring three dimensions: scores obtained for the cornea, iris and conjunctiva. For the cornea, after exposure to the composition, A the cornea opacity is graded on a scale from 1 to 4; B the area of cornea involved is graded on a scale from 1–4 (where the score=A×B×5 may be a total maximum of 80). For evaluation of the iris, after exposure the composition, A the involvement of the iris is graded on a scale of 1–2 (where the score=A×5 may be a total maximum of 10). For a evaluation of the conjunctive, A Redness is graded on a scale of 1–3; B Chemosis is graded on a scale of 1–4; and C Discharge is measured on a scale of 1–3 [where the score=(A+B+C)×2 may be a maximum of 20]. The maximum total score is the sum of all scores obtained for the cornea, iris and conjunctive (a maximum of 110).

The results of the Draize test are reported below. These indicate that an EPA classification Category "3" was appropriate, where corneal involvement or irritation cleared in "21" days or less. These results are in accordance with the guidelines of the Environmental Protection Agency (EPA), 40 C.F.R. Ch.1, §162.10, (1986).

TABLE 4

| Formulation: | Corneal opacity in test subjects / number of days |
|---|---|
| Comp. 1 | 8.33 / 21 |
| Ex.1 | 5 /21 |
| Ex.2 | 4.00 / 21 |
| Ex.3 | 4.67 / 21 |
| Ex.4 | 4.67 / 21 |

As may be seen from these results, the compositions according to Ex. 1 exhibited reduced levels of ocular irritation, as is demonstrated by the degree to which corneal opacity cleared in the test subjects.

What is claimed is:

1. An aqueous disinfecting and cleaning composition in concentrated form which exhibits reduced irritancy which comprises:

a disinfecting effective amount of a quaternary ammonium compound having germicidal properties.

0.01–10% wt. of a nonionic surfactant compound which is based on a polymeric alkylene oxide block copolymer;

a mitigating effective amount of a compound selected from

A) ethoxylated Cellulose wherein the relative weights of the polymeric alkylene oxide block copolymer to the ethoxylated cellulose is from 1:0.1 to 1:1;

C) alkylamidopropylbetaine wherein the relative weights of the polymeric alkylene oxide block copolymer to the alkylamidopropylbetaine is from 2:1 to 1:2;

0.1–10% wt. of a second nonionic surfactant;

0–3% wt. of a polymeric cationic surfactant based on a polyquaternary ammonium salt;

0–3% wt. of a builder;

optionally, minor amounts of up to about 5% wt. of one or more conventional additives particularly coloring agents, fragrances and fragrance solubilizers, viscosity modifying agents such as thickeners, pH adjusting agents and pH buffers including organic and inorganic salts; and, water to form 100% wt. of the aqueous disinfecting and cleaning composition in concentrated form.

2. The concentrate composition according to claim 1 wherein the quaternary ammonium compound having germicidal properties is present in an amount of from about 0.001–5% wt.

3. The aqueous disinfecting and cleaning concentrate composition according to claim 1 wherein the nonionic surfactant compound based on a polymeric alkylene oxide block copolymer is present in an amount of from about 0.1%–8% wt.

4. The aqueous disinfecting and cleaning concentrate composition according to claim 1 wherein the nonionic surfactant compound based on a polymeric alkylene oxide block copolymer is a compound according to the formula:

$$HO—(EO)_x(PO)_y(EO)_z—H \quad (A)$$

where EO represents ethylene oxide

PO represents propylene oxide.

y equals at least 15.

$(EO)_{x+z}$ equals 20 to 50% of the total weight of said compounds, and, the total molecular weight is in the range of about 2000 to 15,000.

5. An aqueous composition which comprises 1 part of the aqueous disinfecting and cleaning concentrate composition according to claim 1 per 10 to 64 parts water.

6. A process for cleaning and/or disinfecting of hard surfaces which comprises the step of:

applying an effective amount of a composition according to claim 1 to the surface.

7. The composition according to claim 1 wherein the mitigating compound is A) ethoxylated cellulose.

8. The composition according to claim 1 wherein the mitigating compound is C) alkylamidopropylbetaine.

* * * * *